US007058347B2

(12) United States Patent
Uejima et al.

(10) Patent No.: US 7,058,347 B2
(45) **Date of Patent: *Jun. 6, 2006**

(54) SURFACE TREATMENT APPARATUS AND IMAGE-FORMING APPARATUS

(75) Inventors: Atsushi Uejima, Kanagawa (JP); Nobuo Matsumoto, Kanagawa (JP); Hiroshi Ishizuka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 117 days.

This patent is subject to a terminal disclaimer.

(21) Appl. No.: 10/712,272

(22) Filed: Nov. 14, 2003

(65) Prior Publication Data

US 2004/0114022 A1 Jun. 17, 2004

(30) Foreign Application Priority Data

Nov. 18, 2002 (JP) ..... 2002-334237

(51) Int. Cl.
*G03G 15/00* (2006.01)
*B41J 2/01* (2006.01)

(52) U.S. Cl. ..... 399/341; 399/390; 347/105

(58) Field of Classification Search ..... 399/329, 399/341, 342, 390; 347/101, 105, 155, 156, 347/212; 430/97, 124; 156/209; 101/17, 101/32; 219/216, 388, 243, 244; 392/417
See application file for complete search history.

(56) References Cited

U.S. PATENT DOCUMENTS 5,153,656 A * 10/1992 Johnson et al. ..... 399/329
5,203,941 A * 4/1993 Spain et al. ..... 156/209
5,672,381 A * 9/1997 Rajan ..... 101/32

FOREIGN PATENT DOCUMENTS

DE 1629805 A * 1/1971
JP 05-053288 3/1993
JP 2001-053943 2/2001

* cited by examiner

*Primary Examiner*—Arthur T. Grimley
*Assistant Examiner*—Ryan Gleitz
(74) *Attorney, Agent, or Firm*—Whitham Curtis, Christofferson & Cook, PC

(57) ABSTRACT

A surface treatment apparatus which can efficiently form fine depressions and protrusions on a sheet selected from an inkjet sheet, a thermosensitive recording sheet, a heat developing sheet, an electrophotographic sheet, and a silver halide photographic sheet, and an image-forming apparatus incorporating this surface treatment apparatus, are provided. For this purpose, a surface treatment apparatus incorporating a sheet heating unit which heats a sheet having at least a thermoplastic resin layer, and a sheet depression and protrusion-forming unit disposed on the downstream process side of the sheet heating unit which forms depressions and protrusions on the thermoplastic resin layer, is provided.

21 Claims, 3 Drawing Sheets

SURFACE TREATMENT APPARATUS AND IMAGE-FORMING APPARATUS

BACKGROUND OF THE INVENTION

1. Field of the Invention

The present invention relates to a surface treatment apparatus which can efficiently form fine depressions and protrusions in any sheet selected from among an inkjet sheet, thermosensitive recording sheet, heat-developing sheet, electrophotographic sheet and silver halide photographic sheet, and to an image-forming apparatus comprising this surface treatment apparatus.

2. Description of the Related Art

In the past, images have been formed by various methods such as silver halide photography, heat developing, inkjet recording, thermosensitive recording and electrophotography. In the prior art, techniques for controlling the gloss of image prints obtained by these various methods were not well-known.

However, Japanese Patent Application Laid-Open (JP-A) No. 05-053288 discloses a photographic apparatus which, in addition to a processor part which produces a printed photograph by developing a printing paper which has been bake-exposed, also comprises a drying part and surface texture treatment part to finish the printed photograph. The surface texture treatment part of this photographic apparatus comprises a pressure roller having surface depressions and protrusions which forms a predetermined surface texture on the printed photograph surface, and a shift mechanism which sets this pressure roller in a state where it can be pressed against the printed photograph. As a result, printed photographs having a desired surface texture can easily be obtained without replacing printing papers or interrupting the bake-exposure.

However, the surface texture treatment part in this photographic apparatus described in the aforesaid JP-A No. 05-053288 had a construction wherein the printed photograph surface was pressed by a pressure roller having a desired transfer roughness, and the depressions and protrusions on the pressure roller surface were transferred to the printed photograph. The surface texture treatment part of this photographic apparatus was adapted for use only with silver halide photographic sheets. Also, to obtain particular surface textures, it was necessary to provide a number of rollers having surface roughness for each texture, so in practice only about 1 to 3 surface textures could be realized. Therefore, according to JP-A No. 05-053288, only one type of treatment could be performed, there was no systematic generality, and performance was unsatisfactory from the viewpoints of working efficiency and energy efficiency.

In JP-A No. 2001-053943, an image-forming system was proposed wherein color information and gloss information are acquired from an image, and image recording is performed on a recording medium based on these two types of image information. Image recording is performed by converting gloss information or non-gloss information into the thermal energy of a thermosensitive head.

In the aforesaid JP-A No. 05-053288 and JP-A No. 2001-053943, surface treatment is performed by applying heat and pressure to an image-forming layer, but there is no mention of the surface treatment of the thermoplastic resin layer, and even if the surface of the image-forming layer alone is treated, the depression and protrusion pattern formed on the surface (interface) of the thermoplastic resin layer underneath has an effect on the image-forming surface due to time-dependent variation, so a desired depression and protrusion pattern cannot be obtained.

Moreover, if a contact member is released from the sheet at high temperature, the depression and protrusion pattern on the contact member transferred to the thermoplastic resin layer and image-forming layer sometimes produced an undesirable plastic deformation due to external factors. Moreover, if a surface coating layer (transparent clear layer) is provided to improve the gloss as described in the aforesaid JP-A No. 2001-053943, it led to higher costs.

It is therefore an object of the present invention to provide a surface treatment apparatus which can efficiently form fine depressions and protrusions in any sheet selected from among an inkjet sheet, thermosensitive recording sheet, heat-developing sheet, electrophotographic sheet and silver halide photographic sheet, and to an image-forming apparatus comprising this surface treatment.

SUMMARY OF THE INVENTION

The surface-treatment apparatus of the present invention comprises a sheet heating unit which heats a sheet comprising at least a thermoplastic resin layer, and a sheet depression and protrusion-forming unit disposed on the downstream process side of the sheet heating unit which forms depressions and protrusions on the thermoplastic resin layer. In this surface treatment apparatus, the sheet heating unit heats the sheet comprising at least the thermoplastic resin layer. The sheet depression and protrusion-forming unit, which is disposed on the downstream process side of the sheet heating unit, forms depressions and protrusions on the thermoplastic resin layer. As a result, fine depressions and protrusions are efficiently formed on the sheet.

The image-forming apparatus of the present invention comprises an image-forming unit which forms a visible image on a sheet, and the surface treatment unit of the present invention which performs surface treatment of the sheet on which the image is formed by the image-forming unit. In this image-forming apparatus, by combining the surface treatment unit which efficiently forms depressions and protrusions on at least one of the thermoplastic resin layer and image-forming layer of the sheet, with the image-forming unit, good images can be efficiently formed with various surface textures.

Figure 1:
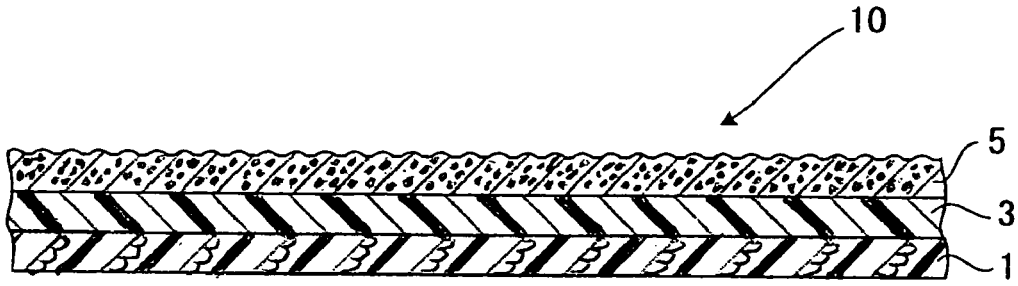
FIG. 1 is a schematic cross-sectional view showing one example of a sheet according to the present invention.

DESCRIPTION OF THE PREFERRED EMBODIMENTS (Surface Treatment Apparatus)

The surface treatment apparatus of the present invention comprises a sheet heating unit, a sheet depression and protrusion-forming unit, and other units suitably selected as necessary.

Sheet Heating Unit

The sheet heating unit is not particularly limited, provided that it can heat the sheet to such a temperature that its thermoplastic resin layer softens so that it can deform, and the thermoplastic resin layer can be made to deform by applying pressure. Thus, it may be suitably selected according to the purpose from among those used as fixing unit in electrophotographic apparatuses known in the art, for example, a pair of heating rollers disposed so that the sheet is brought into pressure contact from its inner side and outer side, a combination of a heating roller and pressure roller disposed so that the sheet is brought into pressure contact from its inner side and outer side, or an infrared irradiation apparatus.

The heating temperature produced by the sheet heating unit is not particularly limited and may be suitably selected depending on the type of sheet, but it is preferably heated to a temperature above the softening point of the thermoplastic resin in the aforesaid thermoplastic resin layer. For example, this is normally of the order of 50 to 120° C., but if the sheet has a thermoplastic resin layer, it is preferably 80 to 110° C., and if the thermoplastic resin is polyethylene resin, it is more preferably 95 to 105° C. Due to this, the thermoplastic resin layer surface (interface) can easily suffer plastic deformation, and the depression and protrusion pattern on the sheet depression and protrusion-forming unit is transferred by pressure to the thermoplastic resin layer even at a relatively low pressurizing force. Further, it is more preferably heated to a temperature above the softening point of the image-forming layer.

The pressure produced by the sheet heating unit is preferably within a pressure range of 7 to 20 kgf/cm$^2$ in the nip part.

Sheet Depression and Protrusion-forming Unit

The depression and protrusion-forming unit is not particularly limited and may be suitably selected according to the purpose, e.g., (1) a unit which forms depressions and protrusions wherein plural wires are selectively driven by an actuator so that a shock is imparted to the sheet surface by depression and protrusion-forming members at the ends of the wires, (2) a unit which presses a roller having depressions and protrusions against the sheet, and (3) a unit which forms depressions and protrusions by applying an electric field to the sheet.

The depression and protrusion-forming unit in the aforesaid unit (1) is not particularly limited provided that end surface shapes which impart the shock of the wires can form depressions and protrusions, e.g., a dot impact printer head or the like. Further, the actuator used by the dot impact printer may for example be the magnetic field moving type. Due to the use of this unit (1), the size of the depressions and protrusions can be continuously selected without making the image-forming apparatus bulky.

The dot impact printer prints by striking a cloth impregnated with ink (ink ribbon) with a dot impact printer head.

According to the present invention, the dot impact printer head is fitted as the sheet depression and protrusion-forming unit of the surface treatment apparatus which forms depressions and protrusions on the sheet surface.

Herein, the dot impact printer head is built into the surface treatment apparatus, and when it is operated, the depression depth, protrusion height and surface depression and protrusion density can all be easily adjusted, so that fine depressions and protrusions can be efficiently and continuously formed. Also, the depression and protrusion density (depression depth, protrusion height and surface depression and protrusion density) in one image can be selectively modified according to the nature of the image formed on the sheet. Specifically, (i) the members imparting the shock of the wires (dot impact printer head) may have plural surface shapes (depression and protrusion shapes), and selectively driven according to the nature of the image, or (ii) the members imparting the shock of the wires (dot impact printer head) may have identical end surface shapes (depression and protrusion shapes), and selectively driven according to the nature of the image depending on the pitch and drive force of the wires which are driven.

The unit (2) which presses the roller having surface depressions and protrusions against the sheet may comprise a rubber roller having surface depressions and protrusions which is pressed against the sheet, wherein the depression depth, protrusion height and surface depression and protrusion density may all be adjusted by suitably varying the pressure. The depressions and protrusions height (depth) is for example of the order of 0.1 to 0.5 mm, and the surface depression and protrusion density is for example such that the depression and protrusion interval (period) is of the order of 0.1 to 0.5 mm.

The unit used to form the depressions and protrusions on the rubber roller surface is not particularly limited and may be suitably selected according to the purpose, for example, a method known in the art such as shot blasting, electrical discharge treatment or laser treatment may be used.

Due to use of the aforesaid unit (2), the degree of depressions and protrusions can be continuously selected by continuously selecting the pressing force without making the image-forming apparatus bulky, and depressions and protrusions can be formed with very high efficiency on the sheet surface.

The depression and protrusion height (depth) of the depressions and protrusions formed in the thermoplastic resin layer and image-forming layer of the sheet by the aforesaid sheet depression and protrusion-forming unit is for example of the order of 10 to 100 μm, and the surface density of the depressions and protrusions are for example such that the depression and protrusion interval (period) is of the order of 10 to 300 μm.

The depression depth, protrusion height and surface depression and protrusion density may be suitably adjusted according to customer specifications. As a result, there is smooth compliance with user requirements, depressions and protrusions having a regulated depression depth, protrusion height and surface depression and protrusion density can be formed, and the method is of great usefulness.

The unit used to provide user information is not particularly limited and may be suitably selected according to the purpose, for example manual input by user, online input, Internet or portable terminals. The user information is not particularly limited and may be suitably selected according to the purpose, for example, in addition to depression depth, protrusion height and surface depression and protrusion density, other information may include the surface nature of the contact member (glossy, matt or embossed), the number of sheets treated and the paper size (A4, B4, A3, B5, etc).

The sheet depression and protrusion-forming unit preferably forms depression and protrusion shapes which can be varied in different parts of one sheet according to the image formed on the sheet. For example, the sheet depression and protrusion-forming unit may form depressions and protrusions only in the main part of the sheet by controlling the pressure force of the wires and roller according to the object material in the image, or according to the main transfer object and background in the image.

In the sheet depression and protrusion-forming unit, the sheet must be heated to a predetermined temperature, so a sheet heating unit is disposed upstream of the sheet depression and protrusion-forming unit and a sheet heat-retaining unit is preferably provided in the sheet depression and protrusion-forming unit.

Other Unit

Other unit may include a sheet heat-retaining unit, contact unit, cooling unit and positioning unit.

The contact unit may for example be a sheet cut to a predetermined size and shape, or an endless belt.

In the present invention, the temperature must be raised to a predetermined temperature until depressions and protrusions are formed on the sheet by the sheet depression and protrusion-forming unit, so a sheet heating unit is preferably provided upstream of the sheet depression and protrusion-forming unit, and a sheet heat-retaining unit on the opposite side to the sheet depression and protrusion-forming unit to maintain the sheet temperature. The sheet heat-retaining unit may for example be a heater or the like.

The cooling unit can preferably cool the sheet treatment surface while it is in contact with the contact unit, and may be selected from among the cooling apparatuses known in the art, but from the viewpoint of being able to control cooling conditions, it is preferably a cooling unit which can adjust the cooling temperature by blowing air. The number of sheet cooling unit is not particularly limited and may be suitably selected according to the purpose.

The positioning unit positions the sheet and contact member. If such a positioning unit is provided, surface treatment can be performed without any positional displacement of the sheet treatment surface which offers excellent surface treatment efficiency and reliability, and this is therefore advantageous.

The positioning unit is not particularly limited and can be suitably selected according to the purpose, but a sensor is convenient. The sensor is not particularly limited, and may for example be a sensor which detects reflected light or reflected sound.

In the present invention, using one of a roller, endless belt and texture sheet as the contact member, the surface quality is preferably adjusted by modifying any of the pressure conditions, heating temperature and cooling temperature in the contact member. As a result, images having different surface qualities in sheet units, or images having different surface qualities within one sheet, can be formed. Moreover, plural rollers, belt and texture sheets having different surface roughnesses are unnecessary, and an apparatus to interchange them is also not required. It may also be noted that, as it is possible to modify any of the pressure conditions, heating temperature and cooling temperature in one sheet, a variation of surface quality may be given to one sheet so that visual effects are obtained due to gradation.

In this case, the method of modifying pressure conditions in the sheet heating unit is not particularly limited and may be suitably selected according to the purpose, for example a method which makes the spring length of nip springs at the two ends of the pressure rollers variable. The method of making the spring length variable may for example be a method due to the rotation of a cam, or a method which varies the position of a stopper by a mechanism.

The method of modifying the heating conditions in the sheet heating unit is not particularly limited and may be suitably selected according to the purpose, for example a method which makes the temperature of the heaters in the heat rollers variable. The method of making the temperature variable may be to dispose a temperature detecting apparatus on a roller surface outside the paper passage part, and control this to a desired temperature.

In practice, the surface quality of the sheet may conveniently be modified as shown in the following Table 1 and Table 2 using any of a roller, endless belt and texture sheet as the contact member.

TABLE 1

| Finish | Gloss treatment |
|---|---|
| Heating temperature parameter | Low ↔ High |
| Sheet surface smoothness after surface treatment | x ↔ ○ |
| Pressure parameter | Low ↔ High |
| Sheet surface smoothness after surface treatment | x ↔ ○ |
| Cooling temperature parameter | Low ↔ High |
| Sheet surface smoothness after surface treatment | ○ ↔ x |

TABLE 2

| Finish | Matt treatment |
|---|---|
| Heating temperature parameter | Low ↔ High |
| Sheet surface unevenness after surface treatment | x ↔ ○ |
| Pressure parameter | Low ↔ High |
| Sheet surface unevenness after surface treatment | x ↔ ○ |
| Cooling temperature parameter | Low ↔ High |
| Sheet surface unevenness after surface treatment | ○ ↔ x |

Note:
In Tables 1 and 2, "○" means good, and "x" means bad.

The following relations may be determined from Table 1 and Table 2.

In the case of gloss treatment (smoothing of surface), (1) the surface is smoother, the higher is the heating temperature, (2) the surface is smoother, the higher is the pressure, (3) the surface becomes rough when the temperature of the separation part is equal to or higher than the softening point temperature of the thermoplastic resin in the thermoplastic resin layer.

In the case of matt treatment (forming depressions and protrusions), (1) the depressions and protrusions are deeper, the higher is the heating temperature, (2) the depressions and protrusions are deeper, the higher is the pressure, and (3) the depressions and protrusions are shallower, when the temperature of the separation part is equal to or higher than the softening point temperature of the thermoplastic resin in the thermoplastic resin layer.

Hence, by controlling one of the heating temperature, pressure force and cooling temperature as a surface treatment condition parameter, images can be formed with different surface qualities in sheet units, or images can be formed with different surface qualities depending on the position of the image within one sheet, even when the same contact member is used.

For example, to treat an image surface using a contact member for gloss treatment whose surface has a high smoothness, it is possible to transfer the roughness (or smoothness) profile of the surface of the contact member which has a high smoothness quite faithfully to the image surface (including the interface between the image forming layer and the thermoplastic resin layer thereof) by setting the heating temperature to 110° C. and the pressure to 20 kgf/cm$^2$. By contrast, if the heating temperature is set to 95° C. and the pressure to 7 kgf/cm$^2$, the roughness (smoothness) profile of the surface of the contact member having a high smoothness is transferred unfaithfully to the image surface and therefore an image with less gloss can be obtained. Further, by changing the setting values of the heating pressure from 95 to 110° C. and pressure from 7 to 20 kgf/cm$^2$, it is possible to control the degree of transfer, and thus the reproduction on the image surface, of the surface of the contact member. In addition, it is also possible to control the degree of transfer and reproduction of the surface of the contact member by changing the setting value of the cooling temperature within a range of from the softening point of the thermoplastic resin layer to a temperature about 5 to 30° C. lower than the softening point.

Sheet

The sheet is not particularly limited and may be suitably selected according to the purpose, for example, an inkjet sheet, a thermosensitive recording sheet, a heat developing sheet (e.g., as disclosed in JP-A No. 06-130632), an electrophotographic sheet, a silver halide photography sheet, a silver halide digital photography sheet or the like. The sheet may also be a sheet prior to image-forming or a sheet after image-forming.

The inkjet sheet may for example comprise a color material receiving-layer having a porous structure on a support, wherein a liquid ink such as an aqueous ink (using a dye or pigment as the color material) or oil-based ink, or a solid ink which is a solid at ordinary temperature and is melt-liquefied to supply the printed image, is absorbed by the color material-receiving layer to form the image.

The electrophotographic sheet may for example comprise at least a toner-receiving layer on a support, wherein this toner-receiving layer receives at least one of colored toners and black toner to form the image.

The thermosensitive recording sheet may for example be a thermosensitive transfer sheet having a structure comprising at least a heat-melting ink layer as an image-forming layer on a support, wherein ink from the heat-melting ink layer is heated by a thermosensitive head and is melt transferred to a thermosensitive transfer and recording image-receiving sheet, or a thermosensitive transfer sheet having a structure comprising at least an ink layer containing a heat-diffusing pigment (sublimating pigment) on a support wherein the heat-diffusing pigment from the ink layer is heated by the thermosensitive head and is transferred by sublimation to a thermosensitive transfer and recording image-receiving sheet, or a thermosensitive material used in the thermo-autochrome method (TA method) having a structure comprising at least a heat coloration layer on a support wherein an image is formed by repeatedly heating with a thermosensitive head and fixing by ultraviolet light.

The sheet comprises at least a thermoplastic resin layer on one or both surfaces of a base, comprises an image-forming layer on the thermoplastic resin layer, and if required may further comprise a surface protection layer, interlayer, undercoat layer, cushion layer, charge regulating (prevention) layer, reflecting layer, color tone adjusting layer, storage properties improving layer, anti-adhesion layer, anti-curl layer or smoothing layer.

Figure 2:
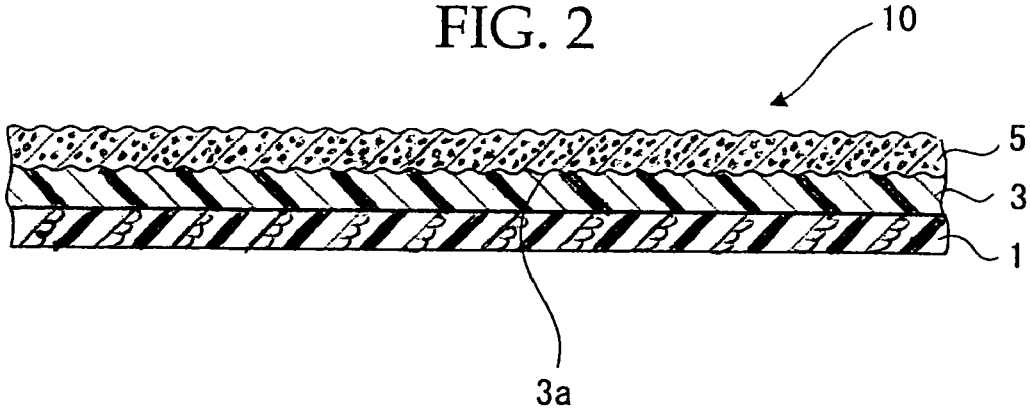
FIG. 2 is a schematic cross-sectional view showing another one example of a sheet according to the present invention.
Figure 4:
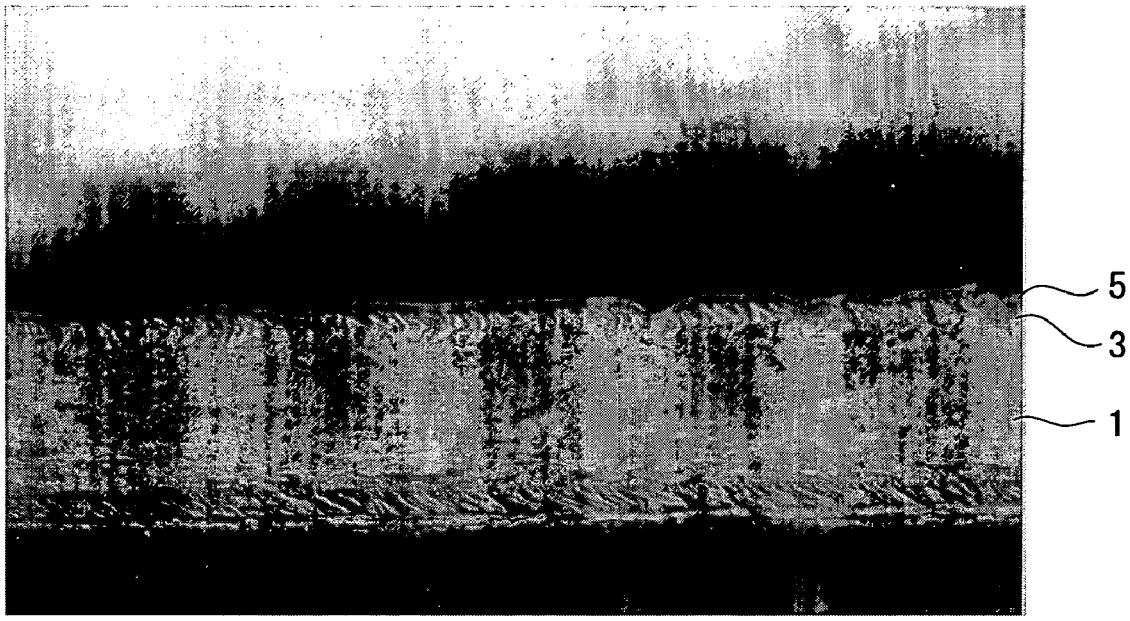
FIG. 4 is a cross-sectional photograph of a sheet after surface treatment.

As shown in FIGS. 2 and 4, a sheet 10 may comprise a thermoplastic resin layer 3 on a base 1, and an image forming layer 5 on the thermoplastic resin layer 3. According to the surface treatment of the present invention, in the sheet 10, the surface quality of the contact member can be transferred not only to the surface of the image forming layer 5, but also to the interface 3*a* of the thermoplastic resin layer 3 with the image forming layer 5 on the image forming layer side. This is observed in the cross-sectional photograph of FIG. 4 (magnification: 138 times), showing that in the cross-section of the sheet 10 after surface treatment, the image forming layer 5 is also deformed following the deformation of the thermoplastic resin layer 3. This shows also that the surface quality is transferred not only to the image forming layer 5 but also to the thermoplastic resin layer 3. In addition, it can be seen that the thickness of the image forming layer 5 is substantially uniform even after the surface treatment.

Base

Examples of the base include synthetic paper (synthetic paper made from, for example, polyolefins or polystyrenes), woodfree paper, art paper, (double-sided) coated paper, (double-sided) cast coat paper, mixed paper made from polyethylene or another synthetic resin pulp and natural pulp; Yankee paper, baryta paper, wallpaper, backing paper, synthetic resin- or emulsion-impregnated paper, synthetic rubber latex-impregnated paper, paper comprising a synthetic resin as an internal additive, paperboard, cellulosic fiber paper, and other paper substrates; films and sheets of plastics or polymers such as polyolefins, poly(vinyl chloride), poly(ethylene terephthalate), poly(styrene methacrylate), poly(ethylene naphthalate), polycarbonate-poly(vinyl chloride), polystyrenes, polypropylenes, polyimides, celuloses such as triacetylcellulose; films and sheets obtained by subjecting these plastic films and sheets to a treatment, such as addition of a pigment such as titanium oxide for imparting white-reflecting properties; fabrics; metals, and glass.

Each of these bases can be used alone or in combination as a multilayer assemblage.

Examples of the base can also be found in JP-A No. 62-253159 (pp. 29–31 in Japanese), JP-A No. 01-61236 (pp. 14–17 in Japanese), JP-A No. 63-316848, JP-A No. 02-22651, JP-A No. 03-56955, and U.S. Pat. No. 5,001,033.

The thickness of the base is generally from 25 to 300 μm, preferably from 50 to 260 μm, and more preferably from 75 to 220 μm.

The stiffness (rigidity) of the base is not specifically limited, can be appropriately selected depending on an intended purpose and are preferably near to those in bases for use in color silver halide photography when the sheet is used as an image-receiving sheet of photographic quality.

The base may further comprise various additives appropriately selected according to the purpose within ranges not adversely affecting the advantages of the present invention.

Such additives include, but are not limited to, brightening agents (whitening agents), conductant agents, fillers, and pigments and dyes such as titanium dioxide, ultramarine blue, and carbon black.

The base may be subjected to any of surface treatments and/or primary coatings at one or both sides thereof to thereby improve adhesion with another layer such as a thermoplastic resin layer arranged thereon.

Such surface treatments include, for example, embossing or printing to form a glossy surface, a fine surface described in JP-A No. 55-26507, a matte surface or a tweed surface, corona discharge treatment, flame treatment, plasma treatment, and other activation treatments.

Each of these treatments can be employed alone or in any combination. For example, the base is subjected to the embossing and then to the activation treatment. It may be further subjected to the undercoating treatment after a surface treatment such as the activation treatment.

The base may be coated with a hydrophilic binder, a semiconductive metal oxide such as alumina sol or tin oxide, and an antistatic agent such as carbon black on its front side and/or back side. Typical disclosure of these coated bases can be found in, for example, substrates in JP-A No. 63-220246.

Thermoplastic Resin Layer

The thermoplastic resin forming the thermoplastic resin layer is not specifically limited, may be selected according to the purpose and includes, for example, polyolefins, poly (vinyl chloride)s, poly(ethylene terephthalate)s, polystyrenes, polymethacrylates, polycarbonates, polyimides, and triacetylcellulose, of which polyolefins are preferred. Each of these resins can be used alone or in combination.

Generally, a low-density polyethylene is used as the polyolefin. However, for improving the thermal resistance of the substrate, it is preferred to use a polypropylene, a blend of a polypropylene and a polyethylene, a high-density polyethylene, or a blend of the high-density polyethylene and a low-density polyethylene. From the viewpoint of cost and its suitableness for the lamination, it is preferred to use the blend of the high-density polyethylene and the low-density polyethylene.

The blend of the high-density polyethylene and the low-density polyethylene is used in a blend ratio (a mass ratio) of, for example, from 1:9 to 9:1, preferably from 2:8 to 8:2, and more preferably from 3:7 to 7:3. When the polyethylene is applied to both sides of the substrate, the polyolefin to be applied to the back side of the substrate is, for example, preferably the high-density polyethylene or a blend of the high-density polyethylene and the low-density polyethylene. The molecular weight of the polyethylenes is not particularly limited. Desirably, both of the high-density polyethylene and the low-density polyethylene have a melt index of 1.0 to 40 g/10-min. and a high extrudability.

The sheet or film to be laminated may be subjected to a treatment to impart white reflection thereto. For example, a pigment such as titanium dioxide is incorporated into the sheet or film.

Image-forming Layer

The image-forming layer, in the case of silver halide photography, corresponds to an emulsion layer which generates the colors YMC, and in the present invention means an emulsion layer prior to exposure and developing, or an emulsion layer after exposure and developing.

In the case of inkjet, it corresponds to an inkjet image-receiving layer which receives ink, and in the present invention means an ink receiving layer prior to adhesion of ink or an ink receiving layer after adhesion of ink.

In the case of electrophotography, it corresponds to a toner image-receiving layer, and in the present invention means a toner image-receiving layer prior to adhesion of toner or a toner image-receiving layer after adhesion of toner.

The image-forming layer and thermoplastic resin layer may be identical.

In the present invention, depressions and protrusions can be formed in at least one of the thermoplastic resin layer and image-forming layer in the sheet. For example, as shown in FIG. 1, in the sheet 10, depressions and protrusions are formed in an image-forming layer 5, and as shown in FIG. 2, in the sheet 10, depressions and protrusions are formed in both the image-forming layer and the thermoplastic resin layer.

Hence, by treating not only the image-forming layer but also the surface (interface) of the thermoplastic resin layer directly underneath it, a desired depression and protrusion pattern can be formed including the image-forming layer.

(Image-forming Apparatus)

The image-forming apparatus of the present invention comprises an image-forming unit, a surface treatment unit and other unit selected as necessary.

Image-forming Unit

The image-forming unit is not particularly limited provided that it can print an image or form an image by coloration on the sheet, and may be suitably selected from image-forming apparatuses known in the art which form images by image-forming methods known in the art such as for example inkjet recording, thermosensitive recording, silver halide photography, silver halide digital photography, heat developing—recording or electrophotography.

Herein, image printing means adhesion of ink or transfer of toner. Coloration means exposure and/or developing of a photoesensitive material, and heating and/or fixing of a thermosensitive material.

The control system in the image-forming unit is not particularly limited and may be selected from among those known in the art. As an example, in the case of a silver halide digital photographic printer, it comprises a laser exposure part and processor part (developing part, bleaching—fixing part, water rinsing part and drying part), these parts being controlled by a ROM, CPU and RAM via an interface.

Surface Treatment Unit

The surface treatment unit is not particularly limited provided that it can perform surface treatment of the sheet on which the image is formed by the aforesaid image-forming unit, and may be selected as appropriate, but the surface treatment apparatus of the present invention described above is particularly suitable.

In the image-forming apparatus, the surface treatment unit may be built into the image-forming unit, or it may be provided externally to the image-forming unit.

Other Unit

There is no particular limitation on the other unit which may be suitably selected according to the purpose, for example, a control unit or the like.

There is no particular limitation on the aforesaid control unit which may be any of those used in image-forming apparatuses known in the art, but it preferably can drive or stop driving the surface treatment unit so as to perform or not perform surface treatment of the sheet.

If the control unit is provided, when the control unit stops driving the surface treatment unit, the image formed by the image-forming unit can be ejected from the image-forming apparatus without passing through the surface treatment unit (bypass route), and when it drives the surface treatment unit, the image formed by the image-forming unit can be ejected from the image-forming apparatus after passing through the surface treatment unit to perform surface treatment.

Hereafter, preferred embodiments of the present invention will be described in more detail referring to the drawings, but it should be understood that the present invention is not limited in any way thereby.

EXAMPLE 1

The surface treatment apparatus according to the present invention will now be described in the case where it is used in an inkjet image-forming apparatus.

Figure 3:
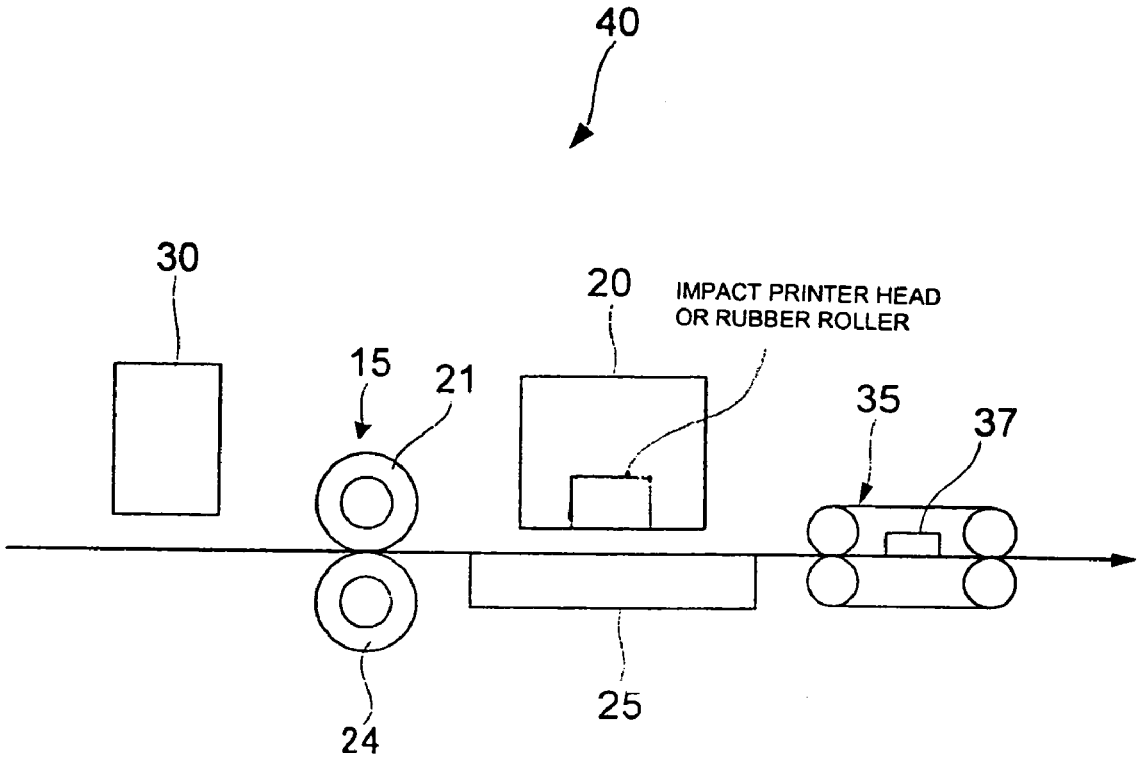
FIG. 3 is a schematic view showing an example of an image-forming apparatus comprising a surface treatment apparatus according to the present invention.

FIG. 3 shows an example of an inkjet image-forming apparatus 40. This image-forming apparatus 40 comprises a sheet heating unit 15 and sheet depression and protrusion-forming unit 20. On the opposite side to the depression and protrusion-forming unit 20, a heat-retaining heater 25 is provided so that the thermoplastic resin layer and image-forming layer can be maintained a temperature higher than the softening point.

The image-forming unit 30 is an inkjet head comprising an image-forming unit, inkjet recording being performed in the recording position, and is disposed upstream of the sheet heating unit 15. In FIG. 3, 35 is a contact unit (e.g., a belt) comprising an internal cooling unit 37 (e.g., a fan). Due to this contact unit 35, after forming depressions and protrusions, the sheet is cooled while maintaining the surface depression and protrusion state, and is subsequently released.

The sheet 10 is an inkjet sheet wherein a color material-receiving layer 5 is formed on a support coated with a polyethylene resin layer 3 on the image-forming layer side of a base paper 1, as shown in FIGS. 1, 2. The sheet in FIGS. 1, 2 shows the state after surface treatment to form depressions and protrusions.

Although not shown in the diagrams, the image-forming apparatus comprises a control unit, which, when surface treatment to form depressions and protrusions are not to be performed, causes the sheet to avoid the surface treatment apparatus so that it does not pass through the surface treatment apparatus, or a bypass is provided which does not pass through the surface treatment apparatus, and the control unit causes the sheet to pass through the bypass.

In Example 1, the sheet heating unit 15 is a combination of a heating roller 21 and pressure roller 24 disposed so that the sheet 10 is in pressure contact from its inner side and outer side. One of the thermoplastic resin layer and image-forming layer of the sheet is heated to the temperature at which it softens and is able to deform. The heating roller 21 and pressure roller 24 may also be replaced by a pair of heating rollers.

In the sheet heating unit 15, the temperature at which one of the thermoplastic resin layer and image-forming layer of the sheet softens and deforms is 80 to 140° C., and the load (pressure) is of the order of several 10 to 500 kgf.

In FIG. 3, 20 is the sheet depression and protrusion-forming unit, and in Example 1, surface treatment is performed, wherein fine depressions and protrusions are formed on the sheet surface using a dot impact printer head 1 and dot impact printer head 2.

<Dot Impact Printer Head 1>

9 Pin Head (Available from Axiohm Transaction Solutions, Inc.)

No. of pins: 9

Pin diameter: 0.30 mm

Pin pattern: Serial

Weight: 27 g

Dimensions: (width×height×depth): 25.6 mm×33.8 mm×38.0 mm

Drive system: Fixed voltage

Voltage: 24 VDC+/−5%

Current: 1.3A (maximum)

This dot impact printer head 1 was installed in an image-forming apparatus, and surface treatment was performed to form depressions and protrusions. As a result, as shown in FIG. 2, depressions and protrusions were formed on the surface of the inkjet image-forming layer 5 and at the interface of the image-forming layer with the polyethylene resin layer 3.

<Dot Impact Printer Head 2>

24 Pin Head (Available from Axiohm Transaction Solutions, Inc.)

No. of pins: 24

Pin diameter: 0.20 mm

Pin pattern: 2×12

Weight: 120 g

Dimensions: (width×height×depth): 42.5 mm×44.5 mm×40.0 mm

Drive system: Chopper

Voltage: 36VDC+/−5%

Current: 1.4 A

This dot impact printer head 2 was installed in an image-forming apparatus, and surface treatment was performed to form depressions and protrusions. As a result, as shown in FIG. 2, depressions and protrusions were formed on the surface of the inkjet image-forming layer 5 and at the interface of the image-forming layer with the polyethylene resin layer 3.

EXAMPLE 2

In Example 2, image-forming and surface treatment were performed on a sheet in an identical way to that of Example 1, except that surface treatment to form depressions and protrusions were performed using a rubber roller having surface depressions and protrusions as the depression and protrusion-forming unit wherein the difference between the height and depth of surface depressions and protrusions were of the order of 0.1 to 0.2 mm and the protrusion interval was of the order of 0.1 mm.

As a result, as shown in FIG. 2, depressions and protrusions were formed on the surface of the inkjet sheet image-forming layer 5 and at the interface of the image-forming layer with the polyethylene resin layer 3.

One example of the surface sheet treatment apparatus and image-forming apparatus of the present invention has been described in detail, but the present invention is not limited thereto, various modifications being possible within the scope and spirit of the invention as outlined in the appended claims.

As described above, according to the present invention, fine depressions and protrusions can be efficiently formed on one of an inkjet sheet, thermosensitive recording sheet, heat developing sheet, electrophotographic sheet and silver halide photographic sheet by a simple modification without making an image-forming apparatus bulky.

What is claimed is:

1. A surface treatment apparatus comprising:

a sheet heating unit which heats a sheet containing at least a thermoplastic resin layer, the sheet being selected from a thermosensitive recording sheet, an inkjet sheet, an electrophotographic sheet, a hot developing sheet, a silver halide photography sheet, and a silver halide digital photography sheet; and a sheet depression and protrusion-forming unit disposed on a downstream process side of the sheet heating unit which forms depressions and protrusions on the thermoplastic resin layer.

2. A surface treatment apparatus according to claim 1, wherein the sheet heating unit heats the sheet at a temperature equal to or higher than the softening point of a thermoplastic resin in the thermoplastic resin layer.

3. A surface treatment apparatus according to claim 1, wherein a thermoplastic resin forming the thermoplastic resin layer is a polyethylene resin.

4. A surface treatment apparatus according to claim 1, wherein the sheet comprises the thermoplastic resin layer and the image-forming layer on a base, and depressions and protrusions are formed on a surface of the image-forming layer and at an interface of the image-forming layer with the thermoplastic resin layer by the sheet depression and protrusion-forming unit.

5. A surface treatment apparatus according to claim 1, wherein the sheet depression and protrusion-forming unit forms depressions and protrusions at a temperature equal to or higher than the softening point of a thermoplastic resin in the thermoplastic resin layer.

6. A surface treatment apparatus according to claim 1, wherein at least one of a depression depth, a protrusion height, and a depression and protrusion surface density can be adjusted.

7. A surface treatment apparatus according to claim 6, wherein the protrusion height is 10 to 100 μm, and a depression and protrusion interval is 10 to 300 μm.

8. A surface treatment apparatus according to claim 1, wherein at least one of a depression depth, a protrusion height, and a depression and protrusion surface density can be adjusted according to customer specifications.

9. A surface treatment apparatus according to claim 1, wherein the sheet depression and protrusion-forming unit forms depressions and protrusions of different shapes in different parts of the sheet according to an image to be formed on the sheet.

10. A surface treatment apparatus according to claim 1, wherein the sheet depression and protrusion-forming unit selectively drives plural wires, and depressions and protrusions are formed by giving impacts to the sheet surface with the wires each comprising a depression and protrusion-forming member attached to the end thereof.

11. A surface treatment apparatus according to claim 10, wherein the sheet depression and protrusion-forming unit is an impact printer head.

12. A surface treatment apparatus according to claim 1, wherein the sheet depression and protrusion-forming unit is a roller having surface depressions and protrusions against the sheet.

13. An image-forming apparatus comprising:

an image-forming unit which forms a visible image on a sheet, and a surface treatment unit, comprising;

a sheet heating unit which heats the sheet comprising at least a thermoplastic resin layer, the sheet being selected from a thermosensitive recording sheet, an inkjet sheet, an electrophotographic sheet, a hot developing sheet, a silver halide photography sheet, and a silver halide digital photography sheet, and a sheet depression and protrusion-forming unit disposed on the downstream process side of the sheet heating unit which forms depressions and protrusions on the thermoplastic resin layer, the surface treatment unit performing surface treatment of the sheet on which an image is formed by the image-forming unit.

14. An image-forming apparatus according to claim 13, wherein the sheet heating unit which heats the sheet at a temperature equal to or higher than the softening point of a thermoplastic resin in the thermoplastic resin layer.

15. An image-forming apparatus according to claim 13, wherein the sheet comprises the thermoplastic resin layer and the image-forming layer on a base, and depressions and protrusions are formed on a surface of the image-forming layer and at an interface of the image-forming layer with the thermoplastic resin layer by the sheet depression and protrusion-forming unit.

16. An image-forming apparatus according to claim 13, wherein the sheet depression and protrusion-forming unit forms depressions and protrusions at a temperature equal to or higher than the softening point of a thermoplastic resin in the thermoplastic resin layer.

17. An image-forming apparatus according to claim 13, wherein the sheet depression and protrusion-forming unit forms depressions and protrusions of different shapes in different parts of the sheet according to an image to be formed on the sheet.

18. An image-forming apparatus according to claim 13, wherein the sheet depression and protrusion-forming unit selectively drives plural wires, and depressions and protrusions are formed by giving impacts to the sheet surface with the wires each comprising a depression and protrusion-forming member attached to the end thereof.

19. An image-forming apparatus according to claim 18, wherein the sheet depression and protrusion-forming unit is an impact printer head.

20. An image-forming apparatus according to claim 13, wherein the sheet depression and protrusion-forming unit is a roller having surface depressions and protrusions against the sheet.

21. An image-forming apparatus according to claim 13, further comprising:

a control unit which conducts one of driving and stopping driving the surface treatment unit so as to control an execution of surface treatment of the sheet.

* * * * *